United States Patent [19]

Kato

[11] 4,304,348

[45] Dec. 8, 1981

[54] ROLL TYPE SHEET MATERIAL FEEDING APPARATUS

[75] Inventor: Heizaburo Kato, Tokyo, Japan

[73] Assignee: Sankyo Manufacturing Company, Ltd., Tokyo, Japan

[21] Appl. No.: 109,030

[22] Filed: Jan. 2, 1980

[30] Foreign Application Priority Data

Mar. 9, 1979 [JP] Japan ..... 54-27385

[51] Int. Cl.[3] ..... B65H 17/22

[52] U.S. Cl. ..... 226/152; 226/166

[58] Field of Search ..... 226/152, 154, 155, 165, 226/166, 158, 151, 142; 74/122, 126, 567, 569

[56] References Cited

U.S. PATENT DOCUMENTS 3,758,011 9/1973 Portmann ..... 226/142

4,032,056 6/1977 Ito ..... 226/154

4,040,553 8/1977 Gotz ..... 226/151

4,144,990 3/1979 Johnson ..... 226/154

*Primary Examiner*—Leonard D. Christian

*Attorney, Agent, or Firm*—Pollock, Vande Sande & Priddy

[57] ABSTRACT

A sheet material feeding apparatus of a roll type includes a main feed roll and an auxiliary roll adapted to cooperate with the main roll to feed a sheet material in a clamped state on a step-by-step basis. The main roll is mounted on an output shaft of an indexing drive unit to be intermittently rotated in one direction. The auxiliary roll is supported swingably toward and away from the main roll. An adjusting mechanism is provided for adjusting the clamping force applied to the sheet material by the auxiliary roll. A release mechanism is provided for releasing the auxiliary roll from the cooperation with the main roll.

10 Claims, 13 Drawing Figures

ROLL TYPE SHEET MATERIAL FEEDING APPARATUS

BACKGROUND OF THE INVENTION

1. Field of the Invention

The present invention relates to a roll type feeding apparatus for feeding intermittently a sheet-like blank material to a processing station on a step-by-step basis. More particularly, the invention concerns a roll type feeding apparatus which includes a main feed roll and a counterpart or auxiliary clamp roll for feeding intermittently a strip-like sheet material to one or more work stations such as metallic molds in a selective manner and which is suited to be incorporated in automated manufacturing machines or other machine tools.

2. Description of the Prior Art

The hitherto known sheet material feeding apparatus of the type described above in which a combination of a one-way clutch and a brake or a combination of a rotating cam and a cam follower for converting a continuous rotation input to an intermittent rotation output for driving intermittently the feeding roller suffer from many shortcomings. For example, it is difficult, not to say impossible, to feed a strip-like blank material stepwise by a predetermined quantity with a reasonable accuracy due to backlash in a gear train, a dimensional tolerance involved in implementing the cam and cam follower mechanism. The feeding operation may not be carried out at a high speed because jamming or deformation of the sheet material being stepwise fed will be then possibly involved. Troublesome and time consuming procedures are required for adjusting the feeding apparatus for different sheet materials having different thicknesses. Further, it has been impossible to vary a quantity of sheet material to be fed through a single feeding step in a stepless manner without interrupting operation of the feeding apparatus as well as associated tool or tools.

SUMMARY OF THE INVENTION

Accordingly, an object of the present invention is to provide a roll type feeding apparatus for feeding a strip-like material intermittently, i.e. on a step-by-step basis which is evaded from difficulties and inconveniences of the hitherto known feeding apparatus such as described above.

Another object of the invention is to provide a sheet material feeding apparatus of roll type which is capable of feeding a strip-like sheet material intermittently by a predetermined quantity with an enhanced accuracy even in a high speed operation without involving jamming, deformation or the like undersirable phenomena.

Still another object of the invention is to provide a roll type feeding apparatus which can be adjusted in a much facilitated manner so as to accommodate different thicknesses of various sheet materials to be fed.

A further object of the invention is to provide a sheet material feeding apparatus of roll type in which the quantity of sheet material to be fed through a single feeding step can be varied in a stepless manner without requiring interruption in operation of the feeding apparatus.

According to a general aspect of the invention, there is provided a roll type feeding apparatus including an indexing drive means having an input shaft rotated continuously and an output shaft rotated intermittently in one rotation direction, a main roll mounted on the output shaft to be rotated together with the output shaft, an auxiliary roll adapted to cooperate with the main roll thereby to feed a sheet material in a state clamped between the main roll and the auxiliary roll, a pair of supporting panels each pivotally mounted at one end thereof on a housing of the feeding apparatus so as to be swingable in a direction orthogonal to the axis of the main roll and adapted to swing the auxiliary roll toward or away from the main roll in dependence on the swinging movement of the supporting panels, and adjusting means for adjusting the swinging movement of the auxiliary roll, the adjusting means including spring means for biasing the supporting panels so that the auxiliary roll is urged to move toward the main roll, and a cam rod rotatably supported in the housing and operatively connected to both of the paired supporting panels thereby to swing the supporting panels simultaneously against the urging direction of the biasing spring upon rotation of the cam rod.

In a preferred embodiment of the invention, the adjusting means further includes a pair of release cams operatively connected to the input shaft of the indexing drive apparatus and disposed each adjacent to each end of the auxiliary roll, and a pair of release links each connected to each of the supporting panels, each of the release links including a first arm having one end pivotally connected to the associated supporting panel at a position adjacent to the free end portion of the panel and extending to a position adjacent to the pivotally mounted location of the panel and having a cam follower at an intermediate portion to be engageable with the associated one of the release cams, and a second arm having one end articulated to the other end of the first arm and extending transversely to the first arm, a release control member connected to the other ends of the second arms of both of the release links and adapted to selectively engage and disengage the cam followers to and from the release cams by swinging the first arms through the second arms.

The above and other objects, novel features and advantages of the invention will become more apparent from the following description of preferred embodiments of the invention. The description makes reference to the accompanying drawings.

DETAILED DESCRIPTION OF THE PREFERRED EMBODIMENTS

Figure 1:
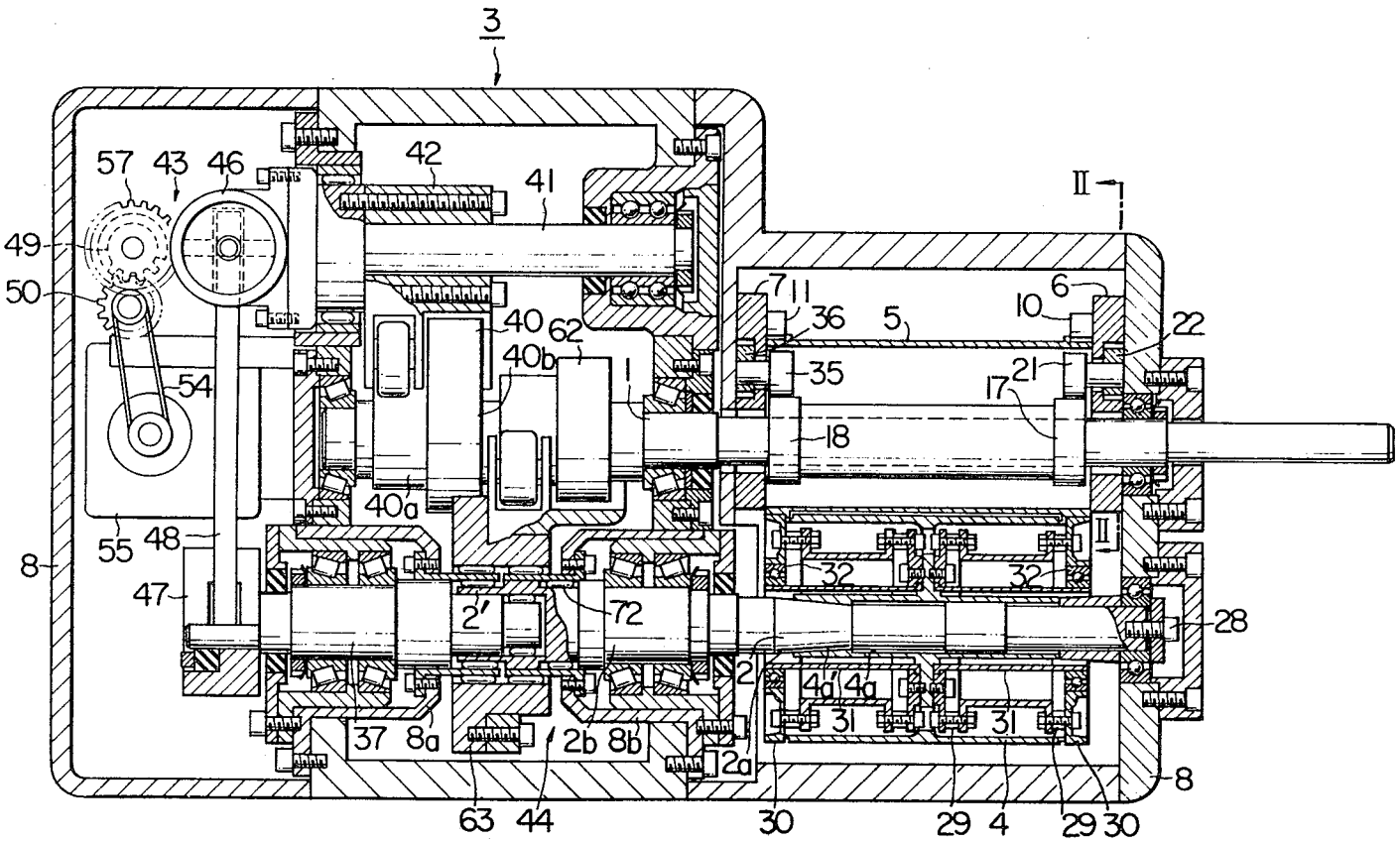
FIG. 1 is a vertical sectional view showing a general arrangement of a roll type feeding apparatus according to an embodiment of the invention.

Referring to FIG. 1 which shows a roll type feeding apparatus according to an embodiment of the invention, the feeding apparatus comprises an intermittent or indexing drive apparatus denoted generally by reference numeral 3 and including an input shaft adapted to be rotated continuously in one direction and an output shaft 2 adapted to be intermittently rotated in one direction, a main roll 4 mounted on the output shaft 2 to be rotated together with the shaft 2, an auxiliary roll 5 disposed so that the axis thereof extends in parallel with the axis of the main roll 4 and adapted to cooperate therewith for feeding a sheet material in a clamped or pinched manner, and a pair of supporting panels 6 and 7 disposed at positions adjacent to both ends of the auxiliary roll 5, respectively.

Figure 2:
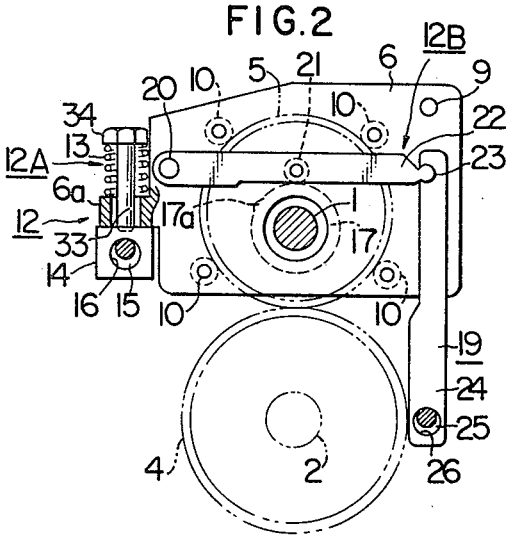
FIG. 2 is a view taken along the line II—II in FIG. 1 to show an adjusting mechanism employed in the feeding apparatus.

Referring to FIG. 2 in combination with FIG. 1, the supporting panel 6 has one end portion which is pivotally mounted on a housing 8 of the roll type feeding apparatus at a position 9 (FIG. 2) so that the panel 6 can be swung in the direction orthogonal to the axis of the main roll 4. There are disposed on the supporting panel 6 four bearings 10 at such positions that the associated end portion (right end portion as viewed in FIG. 1) of the auxiliary roll 5 is circumferentially enclosed and supported by the four bearings 10, as can be seen clearly from FIG. 2. The supporting panel or plate 7 is constructed and arranged in the substantially same manner as the supporting panel or plate 6, whereby the other end portion (left end portion as viewed in FIG. 1) of the auxiliary roll 5 is rotatably supported through cooperation of four bearings 11. In this manner, the auxiliary roll 5 is rotatable about the longitudinal axis thereof and additionally movable toward and away from the main roll 4 in dependence on the swinging movement of the supporting panels 6 and 7 about the pivotally supporting point 9. As will become apparent as description proceeds, the supporting panels 6 and 7 are interlocked to each other so that swinging or rotation of the panel 6 for a predetermined angular distance in the clockwise direction as viewed in FIG. 2, for example, is always accompanied by the corresponding rotation or swinging of the other supporting panel 7 in the clockwise direction. The swinging or rotation of the supporting panels 6 and 7 is adjusted by an adjusting apparatus 12 (FIG. 2) composed of a clamp adjusting mechanism 12A and a release adjusting mechanism 12B, as will be described below.

As is clearly shown in FIG. 2, the supporting panel 6 is constantly biased by a spring 13 in the counterclockwise direction in which the auxiliary roll 5 is urged toward the main roll 4 and has a stopper portion 6*a* which is formed at the right side of the panel 6 and bears against a top surface of an adjusting block 14. The supporting panel or plate 7 is also biased in the counterclockwise direction by a spring and has a stopper portion which bears against an adjusting block in the same manner as the supporting panel 6, although not shown in the drawing. The adjusting blocks 14 for the supporting panels 6 and 7 are mounted on the housing 8 (FIG. 1) so as to be movable in the direction orthogonal to the axes of the rolls 4 and 5, i.e. in the vertical direction as viewed in FIG. 2. Each of the adjusting blocks 14 is formed with a cylindrical through-hole 16 having the axis extending orthogonally to the plane of the associated supporting panel 6 or 7 and adapted to be inserted therethrough a single cam rod 15.

Figure 3:
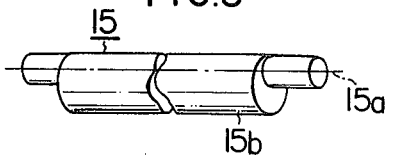
FIG. 3 is a perspective view showing a cam rod used in the adjusting mechanism shown in FIG. 2.

Referring to FIG. 3, the cam rod 15 is constituted by an eccentric rod having an enlarged cam portion 15*b* integrally formed in an eccentric relation to the rotation axis 15*a* of the cam rod 15. The cam rod 15 is rotatably supported in the housing 8 at both ends thereof, while the eccentric cam portion 15*b* is inserted through the cylindrical through-hole 16 formed in each of the adjusting blocks 14 which are disposed adjacent to the associated supporting panels 6 and 7, respectively. In this way, the peripheral surface of the eccentrically enlarged portion 15*b* of the cam rod 15 constitutes a camming surface, while the inner cylindrical surface of the through-hole 16 constitutes a cam follower surface. Thus, upon rotation of the cam rod 15, both of the adjusting blocks 14 are caused to move concurrently in the vertical direction as viewed in FIG. 2, as the result of which the auxiliary roll 5 is moved toward or away from the main roll 4. More specifically, assuming that the adjusting blocks 14 are moved upwardly (as viewed in FIG. 2) against the biasing force of the spring 13 under camming rotation of the cam rod 15, the supporting panel 6 as well as the supporting panel 7 are caused to swing in the clockwise direction as viewed in FIG. 2, resulting in that the auxiliary roll 5 is moved away from the main roll 4. When the adjusting blocks 14 are caused to move downwardly starting from the raised position described above, the supporting panels 6 and 7 are rotated in the counterclockwise direction under the biasing forces exerted by the associated springs 13, whereby the auxiliary roll 5 is returned to the original position adjacent to the main roll 4 as shown in FIG. 2.

The biasing springs 13, the adjusting blocks and the cam rod 15 constitute the clamp adjusting mechanism 12A mentioned hereinbefore which serves to vary the inter-axial distance between the axes of the auxiliary and the main rolls 4 and 5. More specifically, as the adjusting blocks 14 of both the supporting panels 6 and 7 is moved upwardly (as viewed in FIG. 2) in dependence on the rotation of the cam rod in one direction, the inter-axial distance between the auxiliary and the main rolls 4 and 5 is progressively increased, as the result of which the clamping force applied to the sheet material pinched between the rolls 4 and 5 is correspondingly decreased. In this way, it is possible to adjust properly the clamping force applied to the sheet material being fed by adjusting rotation of the cam rod 15 so that the inter-axial distance between the rolls 4 and 5 can be selected in consideration of the spring force of the spring 13, the thickness of the sheet material or the like factors. It should be mentioned that the maximum inter-axial distance between the rolls 4 and 5 attainable by the rotation of the cam rod 15 must be sufficiently large to allow freely the supply as well as extraction of the sheet material to or from the paired rolls 4 and 5.

In the case of the embodiment being described, the cam rod 15 constituted by the eccentric cylindrical rod is inserted rotatably into the adjusting blocks 14 provided respectively for the supporting panels 6 and 7. However, it will be appreciated that the adjusting blocks 14 may be omitted by adopting such modified arrangement in which the supporting panels are formed with respective cam follower surfaces and directly swung by the cam rod 15 having a corresponding camming surface. In FIG. 2, reference numeral 33 denotes a mounting rod for the biasing spring 13 mounted on each of the adjusting blocks 14, and 34 denotes a nut for supporting the spring 13 and simultaneously serving to adjust the biasing force thereof. It should be noted that a manipulating rotatable handle (not shown) is mounted on the cam rod 15 at one end thereof.

The auxiliary or counterpart roll 5 is constituted by a tubular hollow roll which encloses therein an intermediate portion of the input shaft 1 of the indexing drive apparatus 3 which will be hereinafter described in detail. A release cam 17 (FIGS. 1 and 2) is mounted on the input shaft 1 at a position adjacent to the right end of the counterpart roll 5 as viewed in FIG. 1. As is shown in FIG. 2, a release link 19 is pivotally mounted at one end thereof on the supporting panel 6 in the vicinity of the free end or side portion (left side as viewed in FIG. 2) thereof as indicated by 20. The release link 19 is composed of a first arm 22 which extends transversely to a point located in the vicinity of the pivotal mounting point 9 of the supporting panel 6 and has a cam follower 21 mounted at a middle portion, and a second arm 24 which has one end pivotally connected to the free end of the first arm 22 and extends transversely relative to the first arm (in the substantially vertical direction as viewed in FIG. 2). The cam follower roll 21 is adapted to engage with the release cam 17. A second release link similar to the link 19 is provided also for the supporting panel 7, wherein a cam follower 35 mounted on a first arm 36 of the second release link is adapted to engage a release cam 18 mounted on the input shaft at a position adjacent to the left end of the auxiliary or counterpart roll 5, as can be seen from FIG. 1. The second arms of both the release links are connected to a single release control member 25 at lower ends thereof as viewed in FIG. 2.

The control member 25 is constituted by an eccentric rod of a configuration similar to that of the cam rod 15 shown in FIG. 3 and supported rotatably in the housing 8. The enlarged eccentric portion of the release control rod is inserted through circular through-holes 26 formed, respectively, in the lower end portions of the second arms 24 of both the release links. A rotation handle (not shown) is mounted on the control rod 25 at one end thereof. With the arrangement described above, when the eccentric control rod member 25 is rotated in the circular through-holes 26 formed in the second arms 24, the first arms 21 and 36 of the first and the second release links are rotated in the clockwise or counterclockwise direction about the respective pivotal studs 20 as viewed in FIG. 2 in accordance with the rotation of the control rod 25. Assuming, for example, that the first arm 22 is caused to swing in the counterclockwise direction from the position shown in FIG. 2, the cam follower 21 is disengaged from the release cam 17, while at the same time the first arm 36 of the release link provided at the side of the supporting panel 7 is swung in the counterclockwise direction. As the result, the cam follower 35 is moved away from the release cam 18. On the other hand, when the first arms 22 and 36 are rotated in the clockwise direction, the state shown in FIG. 2 is restored in which the cam followers 21 and 35 are in engagement with the respective release cams 17 and 18.

When the cam followers 21 and 35 are engaged with the associated release cams 17 and 18, respectively, the first arms 22 and 36 are intermittently and alternately rotated in the clockwise and the counterclockwise directions about the respective pivotal connections or articulations 23 (FIG. 2) during continuous rotations of the release cams 17 and 18 formed integrally with the input shaft 1. In more particular, only when a protrusion 17*a* of the release cam 17 is engaged with the cam follower 21 during the rotation of the cam 17, the first arm 22 is caused to swing in the clockwise direction about the link articulation 23. Upon occurrence of the pivotal movement of the first arm in the clockwise direction, the pivotal movement is transmitted to the supporting panel 6 through the pivotally connecting stud 20, whereby the supporting panel 6 is caused to swing in the clockwise direction against the biasing force of the spring 13 about the pivotally mounting stud 9. At that time, the adjusting block 14 stands stationarily. When the protrusion 17*a* of the release cam 17 comes to engagement with the cam follower 21, a similar protrusion (not shown) of the release cam 18 is simultaneously brought into engagement with the cam follower 35, as the result of which the supporting panel 7 is pivotally moved in the same direction as the supporting panel 6. Consequently, the auxiliary or counterpart roll 5 supported by the panels 6 and 7 at both ends thereof is moved away from the main roll 4. When the cam followers 21 and 35 are progressively disengaged from the protrusions formed in the associated release cams 17 and 18 upon further rotation thereof, the supporting panels 6 and 7 as well as the associated first cams are caused to swing in the counterclockwise direction under the biasing force of the spring 13, whereby the counterpart roll 5 is moved toward the main roll 4. The movement of the auxiliary roll 5 is stopped when the stopper portions such as 6*a* of the supporting panels bear on the associated adjusting blocks 14.

The release link 19, the eccentric control rod member 25, release cams 17 and 18 and so forth described above constitutes the release mechanism 12B mentioned hereinbefore which serves to release the sheet material from the state pinched between the main roll 4 and the counterpart roll 5 in dependence on the operation of the intermittent drive apparatus 3. The release adjusting mechanism 12B is particularly advantageous when the indexing drive apparatus is operated with a rather poor accuracy. More specifically, the main roll 4 is adapted to be intermittently rotated in one direction together with the output shaft 2 of the indexing drive apparatus 3. As the consequence, the sheet material pinched between the rolls 4 and 5 is also intermittently fed in one direction. In case the operating accuracy of the indexing drive apparatus is not of a degree to be satisfied, the magnitude of the intermittent rotation of the output shaft 2 and hence the feeding quantity of the sheet material for a single advance becomes inaccurate. In general, the roll type feeding apparatus of this kind is employed as a drive source for feeding a blank sheet material intermittently (i.e. on a step-by-step basis) by a predetermined length sequentially to a metallic mold which is usually provided with stopper means brought into contact with the leading edge of the sheet material when a predetermined quantity of the sheet material has been supplied. Accordingly, when the actually supplied quantity of the sheet material has exceeded the predetermined quantity due to inaccurate operation of the output shaft 2, there arises a danger that deformation of distortion may be produced in the sheet material due to the action of the stopper means provided for the metallic mold. This problem is solved by the release mechanism 12B described above. Namely, the supporting panels 6 and 7 are swung to move the counterpart roll 5 away from the main roll 4 thereby to release the sheet material from the clamped or pinched state and stop the feeding thereof, when the input shaft 1 as well as the release cams 17 and 18 has been rotated for an angular distance corresponding to a feeding quantity of the sheet material preselected for a single feeding step. In this manner, the feeding quantity of the sheet material during a single feeding step can be controlled accurately even when the magnitude of rotation of the output shaft 2 exceeds a predetermined value. If it is desired that the release mechanism 12B is to be inoperative, this can be easily accomplished by merely rotating the control member 25 thereby to move the second arms 24 upwardly from the position shown in FIG. 2. In this case, the inter-axis distance between the rolls 4 and 5 is maintained at a distance adjusted by means of the clamp adjusting mechansim 12A.

In the case of the illustrated embodiment, it is assumed that the feeding apparatus is provided with both the clamp ajusting mechanism 12A and the release adjusting mechanism 12B. However, it will be readily appreciated that the release adjusting mechanism 12B may be omitted. Further, although the control rod 25 is employed for moving simultaneously the second arms for the supporting panels 6 and 7 for the same distance in the vertical direction, it is self-explanatory that the release adjusting mechanism 12B may be operated easily and appropriately by using other type cam combination.

As is shown in FIG. 1, the main roll 4 is constituted by a double-walled tubular roll. The mounting of the main roll 4 on the output shaft 2 is effected by snugly fitting a slanted surface 4*a*′ formed in the inner tubular wall 4*a* on a complementarily slanted portion 2*a* formed in the output shaft 2. With this arrangement, it is possible to mount securely the main roll 4 on the output shaft for simultaneous rotation by displacing main roll 4 to the left as viewed in FIG. 1 thereby closely engaging the slanted surfaces 4*a*′ and 2*a* to each other by means of a clamping bolt 28. In FIG. 1, reference numeral 29 denotes a flexible coupling, 30 denotes a rotation transmitting plate, and 31 denotes a radial spring for supporting the rotation transmitting plate 30 through a bearing 32. The radial spring 31 is constituted by a sleeve imparted with a slight elasticity in the radial direction.

The intermittent drive or indexing drive apparatus 3 includes a first cam assembly (composite cam) 40 mounted on the input shaft 1 to be continuously driven, a first turret assembly (or cam follower assembly) mounted fixedly on a turret shaft 41 and adapted to swing in dependence on the rotation of the first cam assembly 40, an intermediate or follower shaft 37 extending substantially in parallel with the turret shaft 41 and the output shaft 2 mentioned hereinbefore and positioned in alignment with the follower shaft 37, an interlocking mechanism 43 for opertively connecting the turret shaft 41 and the follower shaft 37 to each other and a clutch mechanism 44 for operatively disengageably coupling the follower shaft 37 and the output shaft 2 to each other.

Figure 4:
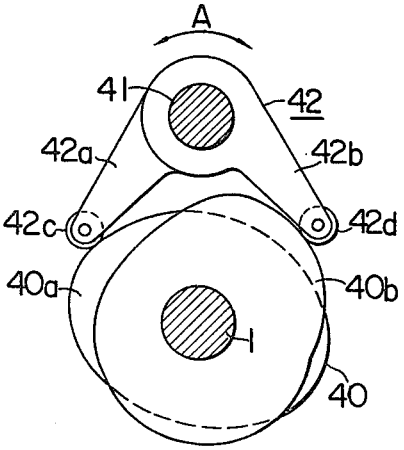
FIG. 4 illustrates a positional relationship between a first cam assembly and a first cam follower turret of an indexing drive apparatus incorporated in the feeding apparatus shown in FIG. 1.

Referring to FIGS. 1 and 4, the first turret assembly 42 is in an inverted V-like form and has a pair of legs 42*a* and 42*b* which are provided with cam follower rolls 4*c* and 4*d* at respective lower or free ends thereof. On the other hand, the first cam assembly 40 is constituted by a pair of cam discs 40*a* and 40*b*. It will be noted that the turret assembly 42 and the first cam assembly 40 are so disposed relative to each other that the cam follower roll 42*c* rests on the peripheral camming surface of the cam disc 40*a* while the cam follower roll 42*d* follows the rotation of the cam disc 40*b*. In this manner, when the cam assembly 40 is rotated continuously in one direction together with the input shaft 1, the first turret assembly 42 is caused to swing with the turret shaft 41 being rotated in an oscillating manner as indicated by an arrow A in FIG. 4. The swinging movement of the first turret assembly 42 will of course depend on the geometrical configuration or profile of the cam discs 40*a* and 40*b*. It should be mentioned here that the mechanism for converting a rotating movement into a swinging movement or oscillatory rotation with the aid of a combination of cam means and a turret assembly of the type described above has been hitherto known by itself as referred to sometimes as the swinging drive unit or the like. Further, the arrangement such that the cam follower rolls disposed rotatably at the free ends of the bifurcated legs of the inverted V-like member are brought in engagement with the associated cam members which are adapted to be rotated together as an integral unit has also been know in terms of the conjugated cam mechanism. In the case of the illustrated embodiment now being described, by virtue of the adopting of the so-called conjugated cam mechanism, undesirable backlash can be positively prevented from occurrence by maintaining the cam discs 40*a*; 40*b* and the cam follower rolls 42*c*; 42*d* in the mutually engaged state under a preset pressure which can be controllably established by decreasing the distance between the input shaft 1 and the turret shaft 41, whereby vibrations and generation of noises in the operation of the indexing drive apparatus can be effectively suppressed even at a high operation speed. Additionally, a high indexing accuracy can be attained in the operation of the indexing drive apparatus.

Figure 5:
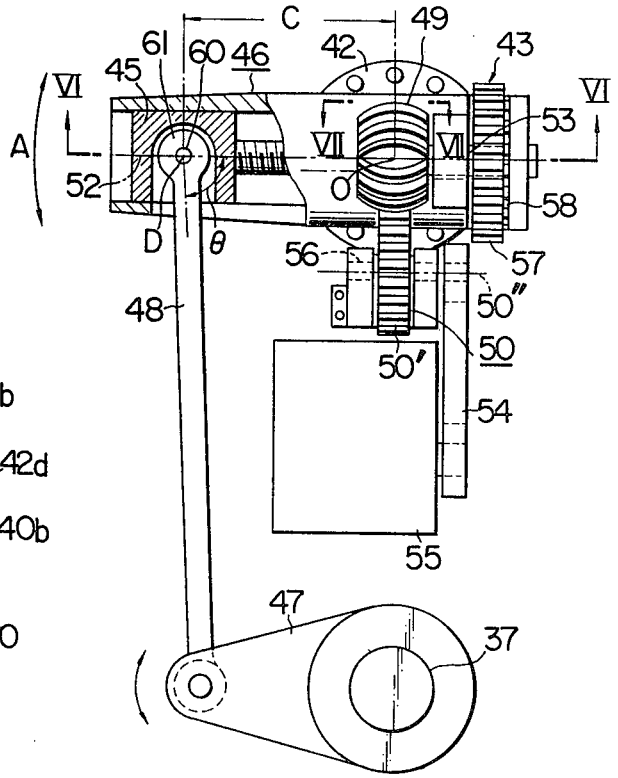
FIG. 5 is a side view showing a structure of an interlocking unit incorporated in the indexing drive apparatus.
Figure 6:
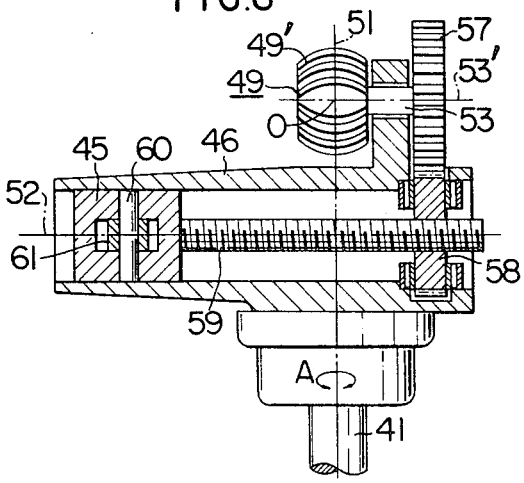
FIG. 6 shows the same in a sectional view taken along the line VI—VI in FIG. 5.
Figure 7A:
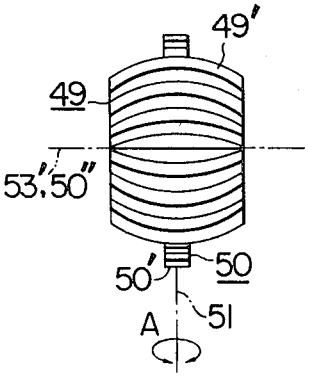
FIG. 7*a* shows an arrangement of a crown gear and a spur gear as viewed in the direction indicated by an arrow-headed line VII—VII in FIG. 5.
Figure 7B:
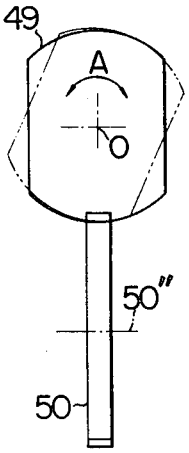
FIG. 7*b* is a detail view illustrate a swinging movement of the crown gear relative to the spur gear.

Referring to FIGS. 5 and 6 in combination with FIG. 1, the interlocking or coupling unit 43 mentioned hereinbefore includes a first swingable arm 46 which extends in a direction substantially orthogonal to the axis of the turret shaft 41 (FIG. 6) and has one end connected fixedly or integrally to the turret shaft 41. A slide member 45 is disposed longitudinally slidably in the first swing arm 46 for the purpose described hereinafter. The interlocking unit 6 further comprises a second swing arm 47 extending substantially in parallel with the first swing arm 46 and fixedly fitted on the follower shaft 37 at in inner end thereof, a connecting rod 11 pivotally connected to a free end of the second swing arm 47 and to the slider member 45, a spherical or crown gear 49 provided at the first swing arm 46, and a spur gear 50 mounted rotatably at a stationary portion of a housing 8 (FIG. 1) and adapted to mesh with the crown gear 49. It should be noted that the spherical gear or crown gear 49 is so mounted as to be swingable about the axis 51 of the turret shaft 41 (FIGS. 6 and 7*a*) together with the first swing arm 46 as indicated by an arrow A in FIGS. 6 and 7*a* and additionally rotatable about the axis 53' extending orthogonally to the turret axis 51 in a plane containing the axis 51 of the turret shaft 41 and the axis 52 of the first swingable arm 46. The crown gear 40 has a semi-spherical surface having the center of curvature at the intersection O of the turret axis 51 and the rotation axis 53' and formed with a number of external gear teeth 49' which extend linearly and arcuately along the direction of the rotation axis 53'. The crown gear 49 is meshed with the spur gear 50 which has gear teeth 50' extending linearly in the same direction as the arcuate teeth 49' of the crown gear 49 (refer to FIG. 7 in particular). With such arrangement of the crown gear 49 and the spur gear 50, swinging of the crown gear 49 about the turret axis 51 in a horizontal direction as indicated by the arrow A as viewed in FIG. 6 will bring about a corresponding movement of the teeth 49 relative to the teeth 50' of the spur gear 50 in the same direction as the swinging of the crown gear 49 about the axis 51. Reference is made to a phantom line position in FIG. 7*b*. On the other hand, when the spur gear 50 is rotated about the center axis 50'' thereof (FIGS. 5 and 7), the crown gear 49 is caused to rotate about the rotation axis 53'. In FIGS. 1 and 5, reference numeral 55 denotes an electric motor for driving the spur gear 50 through a drive belt 54 running around a pulley of the shaft 56 on which the spur gear 50 is fixedly mounted.

Referring to FIGS. 5 and 6, a driving gear 57 is fixedly mounted on the rotatable shaft 53 of the crown gear 49 and meshes with a driven gear 58 which in turn is threadedly mounted on a threaded rod 59 disposed in a guide groove formed in the first swing arm 46 for the slider member 45. It will be noted that the gear 58 is supported stationarily relative to the arm 46. The free end of the threaded rod or shaft 59 is fixedly connected to the slider member 45. With this arrangement, when the motor 55 is operated to drive the spur gear 50 thereby to rotate the crown gear 44 together with the rotation shaft 53 thereof, the driven gear 58 is rotated by the driving gear 57, whereby the threaded shaft 59 and hence the slider member 45 are displaced in a corresponding direction along the axis 52. The purpose of providing the slider member 45 in the manner described above is to allow an angular swing range of the second arm 47 to be varied relative to that of the first swing arm 46, as will be elucidated hereinafter. In FIGS. 5 and 6, reference numeral 60 denotes a pivot pin secured to the slider member 45 and serving for pivotally connecting an enlarged end portion 61 of the connecting rod 48 to the slider member 45. The other end of the connecting rod 48 is also pivotally connected to the second swingable arm 47 in a similar manner (refer to FIG. 5).

Figure 8:
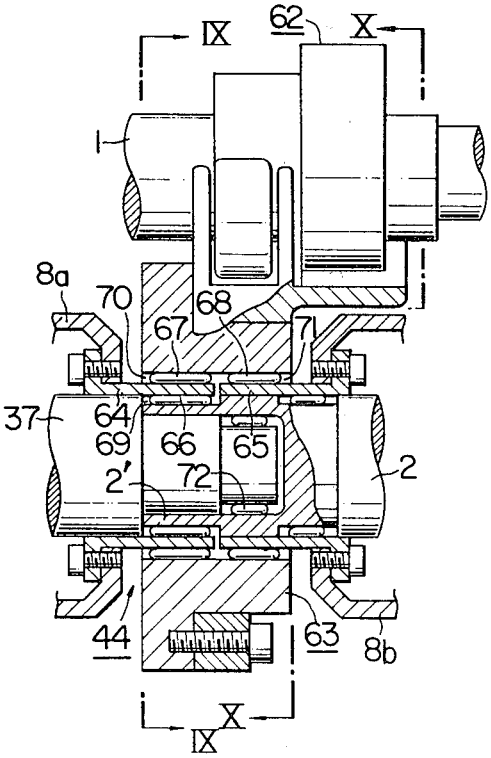
FIG. 8 is a fragmental enlarged view of FIG. 1 showing a structure of a clutch incorporated in the indexing drive apparatus.
Figure 9:
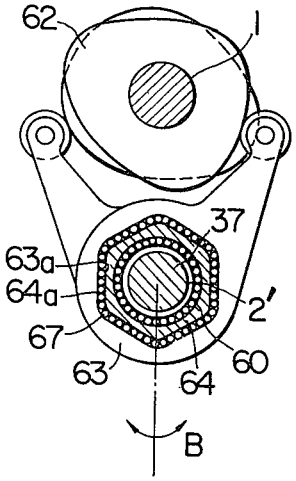
FIG. 9 is a sectional view taken along the line IX—IX in FIG. 8 and viewed in the direction indicated by attached arrows.
Figure 10:
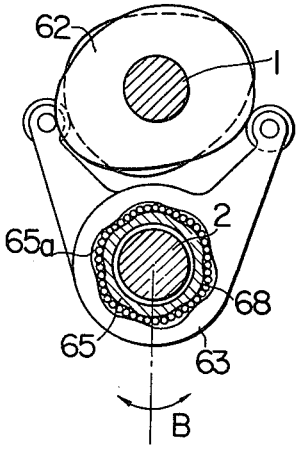
FIG. 10 is a sectional view taken along the line X—X in FIG. 8 and viewed in the direction indicated by attached arrows.

Next, reference is made to FIGS. 8 to 10 in combination with FIG. 1. The inner end portion (right end portion as viewed in FIGS. 1 and 8) of the follower shaft 37 is reduced in diameter and rotatably lodged within a sleeve portion 2' formed integrally in the inner end portion (left end portion as viewed in FIGS. 1 and 8) of the output shaft 2. The follower shaft 37 and the output shaft 2 are adapted to be disengageably coupled to each other through a clutch unit designated generally by reference numeral 44. The clutch unit 44 comprises a second cam assembly 62 fixedly secured to or formed integrally with the input shaft 1 (FIGS. 1 and 8) and a second turret assembly 63 which is disposed so as to enclose the sleeve portion 2' at the coupling location of the follower and output shafts 37 and 2. There are provided between the sleeve portion 2 and the second turret assembly 63 a clutch sleeve 64, a brake sleeve 65 and first to third groups of needle rollers 66 to 68 which are arranged in the manner shown in FIG. 8 The configurations and structures of the second cam assembly 62 and the second turret assembly 63 may be similar to these of the first cam assembly 40 and the first turret assembly 42.

More particularly, referring to FIGS. 1 and 8, the clutch sleeve 64 is inserted between the sleeve portion 2' and an inner peripheral wall 63*a* of the mounting hole formed in the second turret assembly 63 to thereby define first and second annular gaps 69 and 70 between the sleeve portion 2' and the second turret assembly 63, while the brake sleeve 65 is fitted around the end portion of the output shaft 2 adjacent to the clutch sleeve 64 to define a third annular gap 71 in cooperation with the inner peripheral wall 63*a* of the mounting hole of the second turret assembly 63. The clutch sleeve 64 is fixedly secured to a shaft enclosure wall portion 8*a* of the housing 8 at the left end thereof by means of screws, while the brake sleeve 65 is fixedly secured to a similar enclosure wall portion 8*b* at the right end thereof as viewed in FIGS. 1 and 8. As can be best seen from FIGS. 9 and 10, the first to third groups of needle rollers 66, 67 and 68 described above are accommodated within the first, second and the third annular gaps 69, 70 and 71, respectively, with the individual needle rollers being arrayed closely to one another in each of the annular gaps.

The inner peripheral wall 63*a* of the mounting hole formed in the second turret assembly 62 as well as the outer peripheral surface 64*a* of the clutch sleeve 64 are each shaped in the form of a substantially similar equilateral polygon in cross-section (hexagonal shape in the case of the illustrated embodiment), wherein each side of the polygon is profiled in a form of Archimedes' spiral, as can be seen from FIG. 9. It is assumed now that the second turret assembly 63 is rotated for a predetermined angle from the position at which the inner wall 63*a* of the second turret assembly 63 is aligned with the outer periphery 64*a* of the clutch sleeve 64 in respect of the cross-sectional configuration (i.e. the position shown in FIG. 9) to the position shown in FIG. 9*a* in which the cross-sectional profiles in concern are mutually deviated in the peripheral direction from the aligned position. In this state shown in FIG. 9*a*, the inner peripheral wall 63*a* of the second turret assembly 63 will press the second group of needle rollers 67 against the clutch sleeve 64 which will then be pressed radially inwardly. As the consequence, the sleeve portion 2' of the output shaft 2 is additionally pressed radially inwardly against the outer peripheral surface of the follower shaft 37 through the first group of the needle rollers 66. In this manner, the follower shaft 37 is brought into a tight frictional engagement with the-output shaft 2 at the location of the sleeve 2', whereby the follower shaft 37 and the output shaft 2 are in the position to be rotated together as the unitary combined shaft. On the other hand, when the second turret assembly 63 is rotated in the opposite direction indicated by an arrow B in FIG. 9 for the predetermined angle, the aligned position between the second turrret assembly 63 and the clutch sleeve 64 is restored, wherein the follower shaft 37 is idly rotatable within the sleeve portion 2' of the output shaft 2. Thus, drive power transmission from the follower shaft 37 to the output shaft 2 will not take place.

Figure 11:
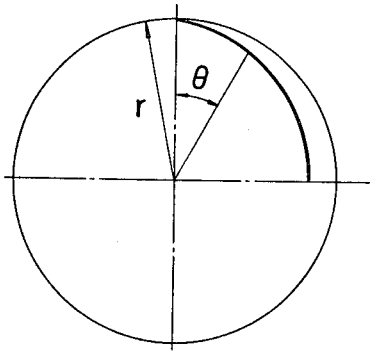
FIG. 11 is a view to illustrate an Archimedes' spiral in accordance with which clutch elements can be profiled.

With the terms "Archimedes' spiral" recited above, it is intended to mean a curve of which radius r varies at a constant rate as a function of a rotational angle $\theta$, i.e. the curve which can be mathematically expressed by $r=K\theta$ where K is a constant, as is illustrated in FIG. 11. Although it has been found that both the inner wall of the second turret assembly 63 and the outer periphery of the clutch sleeve 64 should be preferably formed in a polygon having sides each in a form of the Archimedes' spiral, it will be appreciated that other various curved profiles may be made use of in place of the Archimedes' spiral to the substantially same effect.

As can be seen from FIG. 10, the outer periphery 65*a* of the brake sleeve 65 is also in a form of an equilateral polygon similar to that of the inner camming periphery 63*a* of the second turret assembly 63 with each side being profiled in a curve such as the Archimedes' spiral expressed by the formula $r=K$ or the like. In this connection, it should be noted that the outer polygonal periphery 65*a* of the brake sleeve 65 is circumferentially displaced relative to the polygonal cam periphery 63*a* of the second turret assembly 63 (refer to the position shown in FIG. 10), when the latter is in a position aligned with the outer polygonal periphery 64*a* of the clutch sleeve 64 shown in FIG. 9. In the position shown in FIG. 10, the inner polygonal cam periphery 63*a* of the second turret assembly 63 will press the brake sleeve 65 radially inwardly through the interposed needle rollers 68 of the third group, as the result of which the brake sleeve 65 is enforcively brought into a frictional close engagement with the output shaft 2 to thereby lock the output shaft 2 in the non-rotatable state. In this manner, when the second turret assembly 63 and the clutch sleeve 64 are in the position shown in FIG. 9 in which the follower shaft 37 is rotatable relative to the output shaft 2, the latter is positively prevented from being rotated by means of the brake sleeve 65.

On the other hand, when the second turret assembly 63 and the clutch sleeve 64 are brought to the position shown in FIG. 9 in dependence on the swing movement of the second turret assembly 63 at which position the follower shaft 37 is rotatably coupled to the output shaft 2, the polygonal cam periphery 63*a* of the second turret 63 is geometrically aligned with the outer polygonal periphery 65*a* of the brake sleeve 65, resulting in that the pressing force applied radially inwardly to the brake sleeve 65 is removed, whereby the output shaft 2 is allowed to rotate within the brake sleeve 65. In this way, the follower shaft 37 and the output shaft 2 are set to the position to be rotated together as an integral unit. In FIGS. 1 and 8, reference numeral 72 denotes a needle bearing for assuring a smooth rotation of the follower shaft 37 relative to the output shaft 2. Further, it will be self-explanatory that the first to third needle roller groups 66 to 68 serve also as the bearings for allowing smooth rotation of the follower shaft 37 and the output shaft 2.

Now, description will be made on operations of the indexing drive apparatus 3 of the structure described above.

When the input shaft 1 and the first cam assembly 40 are rotated continuously in a given direction, the first turret assembly 42 is caused to swing under the camming action of the cam assembly 40, resulting in the oscillatory rotation of the turret shaft 41 and hence the swinging movement of the first swing arm 46 fixedly secured to the turret shaft 40 (refer to FIGS. 1, 5 and 6). The swinging movement of the first swing arm 46 is transmitted to the second swing arm 47 by way of the connecting rod 48, whereby the follower shaft 37 fixedly connected to the second swing arm 47 is caused to oscillate in rotation. Further, since the second cam assembly 62 of the clutch apparatus 45 is rotated together with the input shaft 1 thereby causing the second turret assembly 63 to perform a corresponding swinging movement, the second turret assembly 63 and the clutch sleeve 64 will take alternately the positions shown in FIGS. 9 and 9*a*, while the positional relationship between the second turret assembly 63 and the brake sleeve 65 is varied concurrently.

Figure 9A:
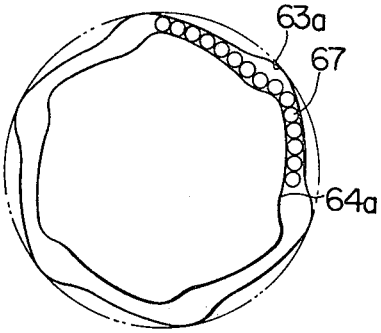
FIG. 9*a* is to illustrate schematically a proportional relationship between an inner cam periphery of a second turret assembly and an outer peripheral surface of a clutch ring in a position at which the second turrent assembly has been rotated for a predetermined angle from the position shown in FIG. 9.

As described hereinbefore, at the position shown in FIG. 9*a*, the follower shaft 37 is rotatable together with the output shaft 2. To the contrary, at the position shown in FIG. 9, the output shaft 2 is held stationarily regardless of the rotation of the follower shaft 37. Accordingly, when arrangement is previously made such that the clutch apparatus 44 takes the operating state illustrated in FIG. 9 upon oscillatory rotation of the follower shaft 37 in one direction while taking the operating state illustrated in FIG. 9*a* upon oscillatory rotation of the follower shaft 37 in the other direction, the output shaft 2 is caused to rotate intermittently only in the one direction. Such arrangement can be easily established by designing appropriately the geometrical or positional relationship between the first and the second cam assemblies 40 and 62.

In the indexing or intermittently drive apparatus described above, it is possible to change the ratio of the swing angle of the second swing arm to that of the first swing arm simply by displacing the slider member 45 (refer to FIGS. 5 and 6) in the first swing arm 46 along the axis 52. As can be seen from FIG. 6, the first swing arm 46 is adapted to swing about the center axis 51 of the turret shaft 41 which corresponds to the point O shown in FIG. 5. Consequently, when the slider memory 45 is displaced along the axis 52, the distance C between the above point O and a connecting point D (FIG. 5) of the first swing arm 46 and the connecting rod 48 will be correspondingly changed, whereby the angle $\theta$ between the axis 52 and the connecting rod 48 is changed correspondingly. Thus, the swing angle of the second swing arm 47 is changed for a predetermined angular displacement of the first swing arm 46, involving a corresponding variation in the rotation angle of the follower shaft 37 and hence the output shaft 2.

The sliding movement of the slider member 45 can be effected by rotating the crown gear 4*a* by the motor 55 through the spur gear 50 to move the screw rod 59 in the axial direction 52 of the first swing arm 46 through the paired gears 57 and 58, as described hereinbefore. Further, the crown gear 49 is also caused to swing due to the swinging rotation of the turret shaft 41 as brought about by the continuous rotation of the first cam assembly 40. In this connection, it should be noted that meshing engagement between the crown gear 49 and the spur gear 50 provides no obstacle to the swinging movement of the first swing arm 46 because the teeth of crown gear 49 are able to move smoothly laterally relative to the teeth of the spur gear 50 in any swinging direction, as described hereinbefore. Of course, the displacement of the slider member 45 can be manually controlled by providing an appropriate handle instead of the motor 55.

With the arrangement of the roll type feeding apparatus disclosed in the foregoing, a sheet material clamped or pinched between the main roll 4 and the counterpart or auxiliary roll 5 is fed intermittently or on a step-by-step basis through intermittent rotation of the output shaft 2 of the indexing drive apparatus 3 and hence of the main roll 4 in one direction, while rotating the input shaft 1 continuously. According to the teaching of the invention, the counterpart roll 5 is moved toward or away from the main roll 4 to set a sheet material to be fed in a clamped state or unclamped state merely through a simple manipulation of rotating correspondingly the cam rod 15 of the clamp adjusting mechanism 12A of the adjusting apparatus 12 shown in FIG. 2, whereby the procedures for supplying and extracting a sheet material to and from the paired rolls 4 and 5 can be advantageously facilitated. Further, by adjusting rotation of the cam rod 15, the inter-axis distance between the rolls 4 and 5 can be varied to thereby adjust the clamping force applied to the sheet material pinched between the feeding rolls 4 and 5 in a simplified manner to an additional advantage.

By virtue of the provision of the release adjusting mechanism 12B for the adjusting apparatus, the feeding of a sheet material can be carried out with an improved accuracy regardless of possible poor operation accuracy of the indexing drive apparatus 3 as described hereinbefore. Further, when the operation of the release adjusting mechanism 12B is not required or exerts adverse influence as in the case where a sheet material is successfully to be fed to different metallic molds for manufacturing different articles, the release adjusting mechanism 12B can be readily inhibited from operation through a simple manipulation of rotating the control rod member 25, which manipulation can be performed without requiring interruption in the operation of the feeding apparatus.

In general, in order to assure an accurate transmission of the intermittent rotation of the output shaft 2 of the indexing drive apparatus 3 thereby to allow the feeding of a sheet material to be carried out accurately and rapidly through the main roll 4 and the counterpart auxiliary roll 5, it is required that both of the rolls 4 and 5 be implemented in a decreased weight to thereby reduce inertias of these rolls. In the case of the illustrated embodiment, such requirement is satisfactorily met by the tubular hollow structures of the rolls 4 and 5. Further, the structure in which the intermediate portion of the input shaft 1 of the indexing drive apparatus 3 is disposed within the counterpart hollow roll 5 with the release cams 17 and 18 being mounted thereon contributes to simplification and compactness of the overall structure of the release adjusting mechanism 12B.

The structure of the indexing drive apparatus 3 described hereinbefore allows the output shaft 2 to be intermittently rotated with a high accuracy for rotating the main feed roll 4. The indexing drive apparatus 3 brings about a great advantage as compared with the conventional indexing drive apparatus using a number of gears and susceptible to backlash and rattling.

With the interlocking mechanism 43 of the arrangement described hereinbefore, it is possible to vary the magnitude of the intermittent rotation of the output shaft 2 and hence the feeding quantity of a blank sheet material in a stepless manner by varying the ratio of rotation angle of the second swing arm 47 to that of the first swing arm 46 through displacement of the slider member 45 along the axis 52. Refer to FIGS. 5 and 6. Thus, the feeding apparatus incorporating the indexing drive apparatus 3 is advantageously suited for use in combination with an automated manufacturing machine or machines designed for manufacturing different articles or products either on a large or small scale basis. More specifically, by varying the rotation angle or oscillation manitude of the output shaft 2 and hence that of the main roll 4, the feeding quantity of the sheet material fed during a single feeding step can be correspondingly changed. Accordingly, when the type or kind of products is to be varied, the feeding quantity of the blank sheet material can be correspondingly changed, whereby the sheet material may be fed to various different machine tools located at different positions.

I claim:

1. In a roll type feeding apparatus enclosed within a housing and including indexing drive means having an input shaft rotated continuously and an output shaft rotated intermittently in one rotating direction, a main roll mounted on said output shaft to be rotated together with said output shaft, and an auxiliary roll adapted to cooperate with said main roll thereby to feed a sheet material in a state clamped between said main roll and said auxiliary roll, the improvement comprising a pair of supporting panels, means for pivotally mounting each panel, at one end thereof, to the housing so as to be swingable in a direction orthogonal to the axis of said main roll and adapted to swing said auxiliary roll toward or away from said main roll in dependence on the swinging movement of said supporting panels, adjusting means for adjusting the swinging movement of said auxiliary roll, said adjusting means including spring means for biasing said supporting panels so that said auxiliary roll is urged to move toward said main roll, and a cam rod rotatably supported in said housing and connected to both of said paired supporting panels thereby to displace angularly said supporting panels simultaneously against the urging direction of said biasing spring means upon rotation of said cam rod.

2. A roll type feeding apparatus according to claim 1, wherein said adjusting means further includes adjusting blocks each disposed in said housing at a position adjacent to a free end portion of each of said supporting panels in opposition to the end portions thereof at which said supporting panels are pivotally mounted, said adjusting block being movable in a direction perpendicular to the axes of said main and auxiliary rolls, said spring means being adapted to urge said free end portion of each of said supporting panels to bear against each of said adjusting blocks, said adjusting blocks having cam follower surfaces therein, said cam rod being formed with a camming surface adapted to engage constantly said cam follower surfaces, whereby upon rotation of said cam rod, said adjusting blocks are caused to move in said direction under camming action of said cam rod, thereby involving correspondingly angular displacement of said supporting panels.

3. A roll type feeding apparatus according to claim 2, wherein said cam rod comprises an eccentric rod having a diametrically enlarged portion with a peripheral surface formed in eccentric relation with the rotation axis of said cam rod, the peripheral surface serving as said camming surface, and further wherein the adjusting blocks include circular holes therein for receiving said enlarged eccentric portion, the holes characterized by surfaces which serve as said cam follower surfaces.

4. A roll type feeding apparatus according to claim 1, 2 or 3, wherein said adjusting means further includes a pair of release cams connected to said input shaft of said indexing drive apparatus and disposed each adjacent to each end of said auxiliary roll, a pair of release links each connected to each of said supporting panels, each of said release links including a first arm having one end pivotally connected to the associated supporting panel at a position adjacent to said free end portion of said panel and extending to a position adjacent to said pivotally mounted location of said panel and having a cam follower at an intermediate portion to be engageable with the associated one of said release cams, and a second arm having one end articulated to the other end of said first arm and extending transversely to said first arm, a release control member connected to the other ends of said second arms of both of said release links and adapted to selectively engage and disengage said cam followers to and from said release cams by swinging said first arms through said second arms.

5. A roll type feeding apparatus according to claim 4, wherein said release control member comprises an eccentric rod rotatably supported in said housing and having a diametrically enlarged portion formed in an eccentric relation to the rotation axis of said rod, circular holes each formed in the other end portion of each of said second arms and adapted to rotatably receive therein said enlarged eccentric portion of said release control rod member, whereby said swing movements of said first arms through said second arms are brought about by camming engagement between said enlarged eccentric portion and said holes through rotation of said release control rod member.

6. A roll type feeding apparatus according to claim 4 or 5, wherein said auxiliary roll is constituted by a cylindrical hollow roll which is arranged so as to enclose an intermediate portion of said input shaft of said indexing drive apparatus.

7. A roll type feeding apparatus according to claim 6, wherein said release cams are mounted on said input shaft adjacent to axial ends of said cylindrical hollow auxiliary roll.

8. A roll type feeding apparatus according to claim 1, wherein said main roll is constituted by a hollow double-walled tubular roll which is formed with an inwardly tapered edge portion in the inner wall, while said output shaft is formed with a complementarily tapered portion so as to be snugly received in said inwardly tapered edge portion of said inner wall.

9. A roll type feeding apparatus according to claim 1, wherein said indexing drive apparatus comprises a first cam assembly connected to said input shaft to be rotated therewith, a turret shaft, a first turret assembly fixedly mounted on the turret shaft and adapted to swing, a follower shaft adapted to be removably connected to said output shaft and extending substantially in parallel with said turret shaft, an interlocking unit for operatively connecting said turret shaft and said follower shaft, and clutch means for removably coupling said follower shaft to said output shaft, said interlocking unit including a first swing arm fixedly secured at one end thereof to said turret shaft and extending sbustantially perpendicularly to said turret shaft, a slider member contained in said first swing arm to be slidably moved in the axial direction of said first swing arm, a second swing arm fixedly secured at one end thereof to said follower shaft and extending substantially in parallel with said first swing arm, a connecting rod for connecting pivotally the other end of said second swing arm to said slider member, a crown gear mounted on said first swing arm to be swingable together with said first swing arm and additionally rotatable about a rotation axis orthogonal to the axis of said turret shaft in a plane containing the axis of said first swing arm and the axis of said turret shaft, and a spur gear meshed with said crown gear, said crown gear being operatively connected to said slider member so that said slider member is slidably displaced relative to said first arm upon rotation of said crown gear, said crown gear being provided with a plurality of arcuate teeth formed on a spherical suface having a center at the intersection of said rotation axis and the axis of said turret shaft and extending in the direction coinciding with said rotation axis so that upon swinging movement of said crown gear, said arcuate teeth of said crown gear are slidable relative to the teeth of said spur gear along the arcuate direction, said clutch means including a second cam assembly mounted on said input shaft, and a second turret assembly provided at coupling portion between said follower shaft and said output shaft and adapted to follow the rotation of said second cam assembly to be correspondingly swung, thereby to control connection and disconnection between said follower shaft and said output shaft so that said output shaft is rotated intermittently only in one direction.

10. A roll type feeding apparatus according to claim 9, wherein said follower shaft portion has an end portion rotatably inserted within a sleeve like portion formed in an adjacent end portion of said output shaft, said clutch means including a second turret positioned to enclose said sleeve portion, a clutch sleeve fixedly secured at one end thereof to a stationary portion of said housing and disposed between said sleeve portion and said second turret so as to define first and second annular gaps between said clutch sleeve and said sleeve portion of said output shaft and between said clutch sleeve and said second turret, respectively, and first and second groups of needle rollers accommodated within said first and second annular gaps, respectively, wherein the inner peripheral surface of said second turret and the outer peripheral surface of said clutch sleeve are formed in cross-section in similar equilateral polygons, each side of which is profiled in a form of an Archimedes' spiral, whereby upon displacement of said second turret to a position where said polygons are deviated from circumferential mutual alignment, said inner peripheral surface of said second turret presses said clutch sleeve radially inwardly through said second group of needle rollers thereby to press said sleeve portion radially inwardly to said follower shaft through said second group of needle rollers to cause said sleeve portion to frictionally engage with said follower shaft portion for simultaneous rotation therewith.

* * * * *